US009060583B2

(12) United States Patent
Barraclough et al.

(10) Patent No.: US 9,060,583 B2
(45) Date of Patent: Jun. 23, 2015

(54) DEVICE AND METHOD

(75) Inventors: Andrew Barraclough, Slough (GB); Michael Wu, GuangZhou (CN); Carl Dibnah, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 948 days.

(21) Appl. No.: 11/578,211

(22) PCT Filed: Apr. 6, 2005

(86) PCT No.: PCT/GB2005/001330

§ 371 (c)(1),
(2), (4) Date: Mar. 16, 2007

(87) PCT Pub. No.: WO2005/096875

PCT Pub. Date: Oct. 20, 2005

(65) Prior Publication Data

US 2007/0215590 A1 Sep. 20, 2007

(30) Foreign Application Priority Data

Apr. 8, 2004 (GB) ..... 0407967.9

(51) Int. Cl.
*A61B 17/50* (2006.01)
*A45D 26/00* (2006.01)

(52) U.S. Cl.
CPC ..... *A45D 26/00* (2013.01); *A45D 26/0014* (2013.01)

(58) Field of Classification Search
CPC ..... A45D 26/00; A45D 26/0014
USPC ..... 606/131, 133, 43, 161; 433/141; 601/137, 141; 604/290; 15/236.08, 15/236.07; 401/266; 30/32, 346, 304, 41, 30/34.2, 40; 219/223
See application file for complete search history.

(56) References Cited

U.S. PATENT DOCUMENTS

| | | | |
|---|---|---|---|
| 2,218,072 | A | 10/1940 | Runnels |
| 4,473,944 | A | 10/1984 | Carroll |
| 4,845,845 | A | 7/1989 | Scott |
| 5,402,697 | A | 4/1995 | Brooks |
| 5,711,076 | A | 1/1998 | Yin et al. |
| 5,771,591 | A | 6/1998 | Armbruster et al. |
| 5,779,654 | A | 7/1998 | Foley et al. |

(Continued)

FOREIGN PATENT DOCUMENTS

| | | |
|---|---|---|
| CA | 2198404 | 8/1998 |
| DE | 591 498 | 1/1934 |

(Continued)

OTHER PUBLICATIONS

PCT Preliminary Report an Patentability, PCT/GB2005/001330, dated Aug. 25, 2006.

(Continued)

*Primary Examiner* — Tuan V Nguyen
*Assistant Examiner* — Tin Nguyen
(74) *Attorney, Agent, or Firm* — Troutman Sanders LLP; Ryan A. Schneider; Elizabeth-Ann Weeks

(57) ABSTRACT

A device for removing a composition from the skin (e.g. a depilatory composition) has a handle (44) and a non-shaving head (46), having an under-surface from which one or more fins (48) projects transversely. The device is held by the handle (44) and moved over the skin so that the fin(s) and the head can remove the composition.

20 Claims, 5 Drawing Sheets

(56) References Cited

U.S. PATENT DOCUMENTS

| | | | | |
|---|---|---|---|---|
| 5,792,159 | A * | 8/1998 | Amin | 606/161 |
| 5,980,541 | A | 11/1999 | Tenzer | |
| 5,984,935 | A * | 11/1999 | Welt et al. | 606/161 |
| 6,015,293 | A * | 1/2000 | Rimkus | 433/141 |
| 6,041,467 | A * | 3/2000 | Roberts et al. | 15/167.1 |
| 6,668,416 | B1 * | 12/2003 | Georgi et al. | 15/167.1 |
| 6,675,479 | B1 | 1/2004 | Walker et al. | |
| 6,691,415 | B2 | 2/2004 | Quals | |
| D508,296 | S | 8/2005 | Dibnah et al. | |
| D511,452 | S | 11/2005 | Dibnah et al. | |
| D512,181 | S | 11/2005 | Dibnah et al. | |
| D515,243 | S | 2/2006 | Dibnah et al. | |
| D525,743 | S | 7/2006 | Dibnah et al. | |
| D525,744 | S | 7/2006 | Dibnah et al. | |
| D527,146 | S | 8/2006 | Dibnah et al. | |
| D558,396 | S | 12/2007 | Sierra et al. | |
| 2002/0128673 | A1 | 9/2002 | Ripich et al. | |
| 2003/0056311 | A1 * | 3/2003 | Broecker et al. | 15/167.1 |
| 2003/0200619 | A1 * | 10/2003 | Kelsey et al. | 15/236.01 |
| 2004/0016126 | A1 * | 1/2004 | deBlois | 30/41 |
| 2007/0215590 | A1 | 9/2007 | Barraclough et al. | |
| 2007/0225733 | A1 | 9/2007 | Barraclough et al. | |
| 2008/0132914 | A1 | 6/2008 | Bossard et al. | |

FOREIGN PATENT DOCUMENTS

| | | |
|---|---|---|
| DE | 203 11 422 | 11/2003 |
| FR | 2 568 465 | 2/1986 |
| GB | 333028 | 8/1930 |
| GB | 2 009 017 | 6/1979 |
| GB | 2 364 502 | 1/2002 |
| GB | 2 384 704 | 8/2003 |
| JP | 5-31129 | 2/1993 |
| WO | WO 96/02369 | 2/1996 |
| WO | WO 03/064121 | 8/2003 |
| WO | WO 2004/107909 | 12/2004 |
| WO | WO 2005/096875 A1 | 10/2005 |
| WO | WO 2005/096876 A1 | 10/2005 |
| WO | WO 2005/096877 A1 | 10/2005 |
| WO | WO 2005/096878 A1 | 10/2005 |
| WO | WO 2005/096879 A1 | 10/2005 |
| WO | WO 2005/096880 A1 | 10/2005 |
| WO | WO 2005/096881 A1 | 10/2005 |

OTHER PUBLICATIONS

PCT International Search Report and Written Opinion, PCT/GB2005/001330, dated Aug. 23, 2005.
PCT International Search Report and Written Opinion, PCT/GB2005/001335, dated Aug. 22, 2005.
PCT International Preliminary Report on Patentability, PCT/GB2005/001335, dated May 10, 2006.
Annual Report & Accounts 2004, Reckitt Benckiser.
PCT Preliminary Report on Patentability, PCT/GB2005/001338, dated Oct. 5, 2006.
PCT International Search Report and Written Opinion, PCT/GB2005/001338, dated Aug. 22, 2005.
Office Action from U.S. Appl. No. 11/547,580 dated Nov. 13, 2008.
Office Action from U.S. Appl. No. 11/547,580 dated Jun. 11, 2009.
Advisory Action from U.S. Appl. No. 11/547,580 dated Oct. 8, 2009.
Office Action from U.S. Appl. No. 11/547,579 dated Aug. 3, 2009.
U.S. Appl. No. 29/307,532, filed Apr. 25, 2008, Dibnah et al., JAR.

* cited by examiner

DEVICE AND METHOD

BACKGROUND OF THE INVENTION (1) Field of the Invention

This invention relates to a device for removing a composition from the skin and to a method for such removal. The invention relates in particular, but not exclusively, to a device for removing a depilatory composition from skin.

(2) Description of Related Art

Depilatory compositions are widely available. The user applies them to their skin, leaves them for a predetermined interval to allow them to work and then removes them from the skin, usually using an article which is provided. This may comprise a flexible plastics sheet. Such a plastics sheet may be formed with a curvature so as to facilitate removal of the composition and the hair entrained with it. However, some consumers find such a device messy, or difficult to use. Many hold such devices close to the leading edge which contacts the skin and consequently it is difficult for them to keep their hand clear of the composition and hair being removed.

It should be noted in that whereas some hairs will have been removed, some may merely have been weakened. It is desirable to break and remove such weakened hairs but present devices are either not well adapted for this purpose, or else may give an acceptable result, but only when used in a non-desired manner—for example (as noted above) by holding a flexible plastics sheet adjacent to its leading edge—and thereby making it likely that the user's hands will come into contact with depilatory composition and entrained hairs.

In addition, the pressure applied to the skin can be significant. In part this is because the action is effected by the pass of a single edge. Another factor is that the contour of the skin does not always match the shape of the edge. When this is the case the shape of the edge (if flexible) and/or the contour of the skin must alter if removal is to be effected across the complete length of the edge. This does not lead to a comfortable or reliable removal process. Another adverse consequence is that the edge may make only intermittent contact with the skin, leading to poor removal and/or increased pressure locally.

BRIEF SUMMARY OF THE INVENTION

According to one aspect of the present invention there is provided a device for removing a composition from the skin, the device comprising a handle and a non-shaving head having an under-surface from which at least one fin projects transversely, the head, in use, being moved over the skin such that the fin effects removal of the composition.

Preferably the device is for removing a depilatory composition and entrained hair, from the skin. The specification will hereafter refer frequently to a depilatory composition or method but it is to be noted that the device could remove other compositions from the skin, notably cosmetic preparations, for example mud packs.

Whilst the device may effect the breaking of some hairs which have been weakened by the depilatory composition it cannot be used as a shaving device. Accordingly it does not have a cutting blade and so is a non-shaving device.

Preferably the head is wider than the handle.

Preferably the average width of the head is at least 50% greater than the average width of the handle, preferably at least 80% greater. For the purpose of this definition the average width of the handle is determined by taking width measurements at 1 cm intervals along the handle, starting 1 cm from its distal (free) end, summating the measurements and dividing by the number of measurements; and the average width of the head is determined by taking width measurements at 0.5 cm intervals along the head, starting 0.5 cm from its distal (free) end, summating the measurements and dividing by the number of measurements.

Preferably the maximum width of the head exceeds the maximum width of the handle. Preferably the maximum width of the head is at least 50% greater than the maximum width of the handle, preferably at least 80% greater.

Preferably the maximum length of the handle exceeds the maximum length of the head, preferably by a factor of at least 3, more preferably by a factor of at least 5. The head will often be quite squat. Nevertheless it will be appreciated that what is meant by "length of the head" is its dimension in the same sense as the length of the handle.

Preferably the handle is slender. Preferably the head is not slender. Preferably it is broad.

Preferably the device has a stick-like or wand-like or rod-like handle, and a wider head.

Preferably the fin(s) is/are substantially perpendicular to the under-surface. Preferably the under-surface is substantially planar. The head itself may suitably be rounded or generally flat. Preferably the fin(s) is/are spaced from the distal end of the head. The fin(s) may suitably project transversely from the distal half of the head. In other embodiments the fin(s) may project transversely from a middle region of the under-surface of the head, intermediate between the distal end on the one hand, and the junction with the handle, on the other hand.

There may be more than one fin projecting transversely from the under-surface of the head. At least one fin may of such a material and/or shape that it effects a more vigorous scraping action than another fin. For example one fin may be of higher modulus than another fin. For example one fin may be of a plastics material and the other fin may be of an elastomeric material. Preferably the plastics material is stiffer and has a more vigorous scraping action, than the elastomeric material.

At least one fin may be of different length to another fin. In such embodiments, suitably the leading fin is longer than the neighbouring fin. Further fins may be progressively shorter still.

The fin(s) may be straight.

The fin(s) may be non-straight.

The fin(s) may be curved or wavy. A preferred curvature being an arc, whose concave side preferably faces towards the handle of the device.

The fin(s) may be wavy. For example it may be of a repeating sigmoidal or zig-zag shape.

The distance between the free edges of at least two adjacent fins may be less than 3 mm. The distance between the free edges of two adjacent fins may be more than 0.5 mm.

The length of the fin(s), from the underside of the head to the free edge of the fin, may be between 1 and 4 mm and is preferably about 2 mm.

The fin, and preferably two or more fins, have a skin-facing surface leading to a free edge of the fin that, in use, is arranged to be at an angle (when relaxed) of less than 90° to the skin with respect to the intended direction of movement of the device to effect removal of the composition. The angle of the fin(s) may be in the region of less than 70° when relaxed, preferably less than 60°. In use, the angle of the fin(s) may be reduced. The angle may be reduced as a result of flexure of the fin(s) on encountering a resisting surface, the skin. The angle may be reduced in normal use by at least 10°, preferably by at least 20°.

Preferably the fin(s) is/are angular and resilient, not sharp or hard, to the extent that they might effect cutting of undegraded hair. Thus, by eye when viewed in magnification, in side sectional view or side elevation, the fin tip(s) can be seen to be radiused, in preferred embodiments. Preferably the radius of their tip(s) is at least 0.25 mm, more preferably at least 0.5 mm, and most preferably at least 0.65 mm. Preferably the radius of their tip(s) is up to 1.5 mm, more preferably up to 1 mm, and most preferably up to 0.85 mm. It may be a compound radius, for example having a major radius in accordance with the definitions given above and a minor radius, smaller than the major radius, at the tip(s). Preferably such a minor radius is up to 0.5 mm, more preferably up to 0.3 mm, most preferably less than 0.25 mm. Preferably it is at least 0.1 mm, more preferably at least 0.15 mm.

At least one fin may have a different profile at its free edge from the profile of the free edge of another fin. At least two fins may have different profiles, for example curvatures, at their free edges. At least three fins may have different profiles, for example curvatures, at their free edges.

When there is more than one fin, preferably the fins are parallel to each other, and are closely spaced. When there are three or more fins the spacing between adjacent fins is preferably substantially the same.

Multiple fins may be transversely spaced apart. By this we mean that one fin lies alongside an adjoining fin.

The fin(s) is/are preferably wide, and may extend from one side of the head to the other. Preferably the fin(s) is/are at least 20 mm in width, more preferably at least 30 mm in width.

Devices which have transversely spaced fins may suitably have up to 16 fins, preferably up to 12 fins, more preferably up to 10 fins, and most preferably up to 6 fins. One preferred embodiment of such a device has four fins only. Another preferred embodiment of such a device has three fins only. An especially preferred embodiment of such a device has two fins only.

In another arrangement multiple fins may be laterally spaced apart. By this we mean that such fins form a row, with a space between them. Such fins are preferably short. Preferably they do not exceed 10 mm in width. The arrangement of fins is such that a group of them is preferably collectively arranged to traverse across skin in use, without leaving areas of skin which have not been traversed. In such embodiments there may be at least two rows of fins, with the fins of one row being aligned with the spaces between the fins of another row. There may suitably be a third row which, likewise, is aligned with the spaces between the fins of the adjoining row. There could be a fourth such row, or further rows. Examples can be seen in FIGS. 12-14, 22 and 23. When there are laterally spaced fins arranged in rows, preferably there are at least two rows. Alternatively small fins need not be arranged in a row or rows, but could be located randomly, but in any case preferably such that a sweep of the device removes an unbroken traverse of composition from the skin.

Devices which have laterally spaced fins may suitably have at least 5 fins, preferably at least 8 fins, most preferably at least 12 fins. Such devices may suitably have up to 50 fins, preferably up to 30 fins. Suitably such fins are arranged in at least 2 rows, preferably at least 3 rows. Suitably such fins are arranged in up to 6 rows, preferably up to 4 rows. Preferably such fins within adjacent rows are staggered from each other, as described above.

The head may include a source of a non-depilatory composition arranged to be applied to the skin when the head is moved over the skin. The non-depilatory composition may, for example, be a moisturiser, a fragrance, an oil (which could be a moisturising and/or fragrancing and/or aromatherapy oil), a colorant (such as a chemical "tanning" product), a soap, an exfoliating agent, a sunscreen, an after-sun agent, a deodorant, a lubricant and an insect repellent. The non-depilatory composition could solid, including a gel. The solid may wear down as it deposits on the skin or may leach a composition onto the skin. The non-depilatory composition may be applied upstream of the fins or downstream of the fins or, from between fins. Preferably, it is applied downstream of the fins. The source of a non-depilatory composition may, for example, comprise a compressible or resilient part such as a fabric ply, felt pad or sponge, may be a film-forming mechanical device, for example a roller, or one of more small recesses, for example in the form of grooves or wells, into which the composition was deposited in manufacture, and from which it is drawn, when rubbed over the skin. Preferably the source of non-depilatory composition is a solid strip comprising a water-soluble polymer and a water-insoluble polymer such as used in razors as lubricant strips.

The head may be removable. It may be interchangeable with an alternative head which is provided.

Preferably the head is firmly carried by the handle, even if it is a head which is removable; in the absence of a force or when merely touched there is no tendency for it to be deflected. In use when bearing upon the skin it may articulate against a resistance force.

The fin(s) may depend from a part of the head which is of the same material as the fin(s), or which is of a different material to the fin(s); suitably a stiffer material. Preferably said part is of a non-elastomeric plastics material and the fin(s) is/are of an elastomeric material.

In accordance with a second aspect of the invention there is provided a method of effecting depilation comprising the steps of:

applying a depilatory composition to the skin;

allowing the composition to remain on the skin for a predetermined interval; and removing the composition and depilated hairs by moving over the skin the head of a device as defined in the first aspect defined above.

Preferably there is an additional step of rinsing the skin to remove any final remnants of depilatory composition.

The present invention also includes a method of effecting depilation as herein referred to when using a device as herein referred to.

BRIEF DESCRIPTION OF THE DRAWINGS

The invention will now be further described by way of example, with reference to the accompanying drawings, all showing depilatory devices (that is, devices for removing depilatory composition and entrained hair from a user's skin). In the drawings.

Figure 1:
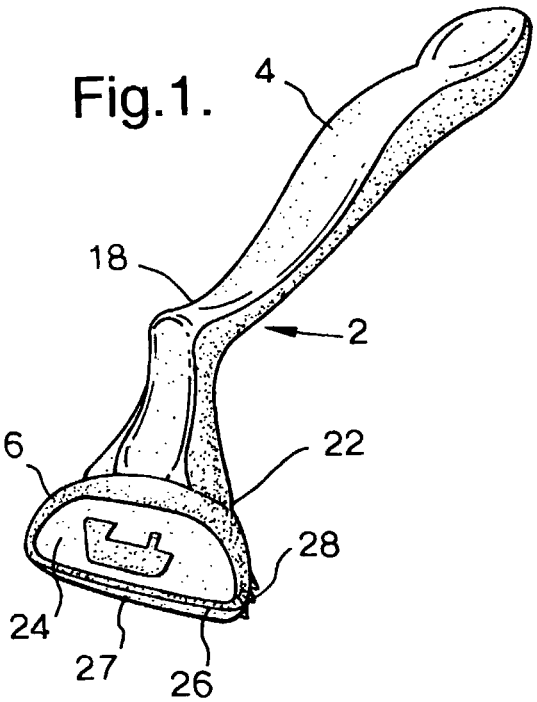
FIG. 1 is a perspective view from above of a first embodiment of depilatory device.

In the drawings shaded areas denote elastomeric material, soft to the touch, whereas areas shown unshaded (or uncoloured) denote plastics material, which is of higher modulus than the elastomeric material. In the following examples there is a difference in colour between the elastomeric and plastics materials. For example the elastomeric material may be coloured and plastics material white, or of a colour which contrasts with the colour of the elastomeric material.

DETAILED DESCRIPTION OF THE INVENTION

The following preliminary comments apply to all embodiments.

Each device has a slender handle (not shown in all of the figures) and a broad head, which has a planar under-surface.

Unless otherwise stated each device is arched.

Unless otherwise stated each device is co-moulded from plastics material and elastomeric material.

Each device is designed to remove depilatory composition and entrained hair from a user's skin, and to this end the head of each device has a plurality of fins. Unless otherwise stated these are of elastomeric material. Removal occurs by the device being drawn over the skin. This generally occurs by a pulling action on the handle, with the head trailing it. For this reason in this specification the fin nearest to the handle is called the leading fin. The fin furthest from the handle, and nearest to the distal end of the head, is called the trailing fin.

Figure 2:
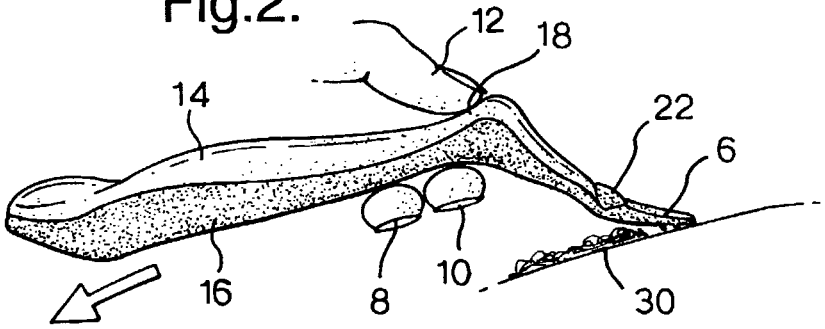
FIG. 2 is a side view of the first embodiment.

The first embodiment of device 2 shown in FIGS. 1 and 2 thus includes a handle 4 and a head 6. As shown in FIG. 2, the handle can be held with the two fingers 8 and 10 on the underside of the handle and the thumb 12 a little forward of those fingers on the upper side. When referring to the underside (or, elsewhere, under-surface) it will be appreciated that this is the side of the device which, in use, will generally face the skin of the user.

The device includes a re-entrant formation 18 on the topside of the handle somewhat towards the head end, and it is this formation which provides the location for the thumb 12. The handle rises to the re-entrant formation in the direction towards the head. Beyond the re-entrant formation the handle falls, until it connects to the head.

Figure 3:
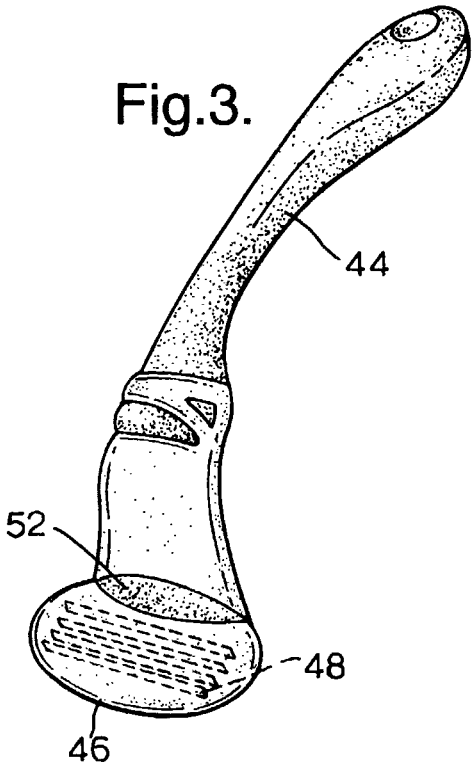
FIG. 3 is a perspective view from above of a second embodiment.

The connection between the handle 4 and the head 6 is via an elastomeric wedge 22. The wedge allows the head to flex to a degree, about the handle. Further flexure may arise from the handle generally. When the user holds the device as shown in FIG. 3 there may in effect be two points of flexure, once being the elastomeric wedge 22, and the other being in the region of the re-entrant formation 18, where the user holds the handle.

The head 6 is generally flat in form and, as with the handle, the topside and underside of the head 6 are of the plastics material and the elastomeric material respectively.

Thus the top of the head 6 is substantially defined by a generally flat plastics body 24. The top of the head has a surrounding rim 26 of elastomeric material, present for reasons of comfort and aesthetics.

The head has a width of about 35 mm, compared to the width of the handle, which varies between 8 and 14 mm along its length.

The underside of the head has a flat under-surface from which three parallel elastomeric fins 28 extend, the complete width of the head. The free edge of each fin is spaced between 1 and 3 mm from an adjacent fin and preferably has a spacing of about 2 mm. The extent to which each fin projects from the underside of the head to the tip of the fin, is preferably between 1 and 4 mm and is advantageously about 2 mm. The tips of the fins may have (in side sectional view) the same or different radii such as at least 0.25 mm or at least 0.5 mm or at least 0.65 mm, and typically up to 2 mm, especially up to 1.5 mm. For instance, the tip of the fin nearest the handle may have a radius of 1.5 mm, the middle fin a radius of 0.85 mm and the remaining fin a radius of 0.65 mm.

The fins 24 may be moulded integrally with the underside 16 of the handle. In an alternative embodiment the fins may be made of a non-elastomeric plastics material. If made of plastics, the fins may be moulded integrally with the plastics material. Non-elastomeric, plastics, fins may be thinner than elastomeric fins in order to be sufficiently flexible.

The device is incapable of being used as a shaving device. When the device of the first embodiment is placed on the skin in its operative position but merely allowed to rest lightly without causing flexure of the fins, the angle of the fins to the adjacent region of skin over which they are traversed in use, is less than 90° and may be about 70° (in contrast the angle of the blades of a shaving device to the adjacent region of skin over which they are traversed during shaving, would be greater than 90°).

In use, depilatory composition is applied to the skin of a user. The composition may, for example, be in the form of a cream, lotion, gel or foam. Usually it employs potassium thioglycolate as its active ingredient. It is spread onto the skin and left for a short, predetermined, period of time—typically a few minutes. The composition degrades the hairs. Some are removed by the composition and others are weakened. Then the device is used to scrape the composition and removed hairs from the skin and to break and remove hair that has been weakened but still remains attached to the skin. This gives an aspect of the invention which is the use of the devices described above for the removal from skin of compositions which have been used to depilate the skin.

Removal is effected by a user holding the handle as previously described, urging the fins against the skin, shown as 30 in FIG. 2, and drawing the device in the direction shown by the arrow in FIG. 2. The angle of the fins to the skin over which they are traversed in the removal operation is reduced to about 45° to 60° by the flexure of the fins.

The leading fin (which means, throughout this specification, the fin which is the first fin to traverse a given area of skin; that is, the fin which is nearest to the handle, given that the handle is used to pull the head across the skin, in use) may pick up most of the depilatory composition and removed hairs and may also detach some of the weakened hairs. The middle fin may remove a small portion of remaining chemical and removed hairs and may also detach a few more weakened hairs. The middle fin, as it acts so close to the leading fin, may also detach weakened hairs that have been removed or pulled by the leading edge at a point closer to the root as the hair may have been raised up slightly from the skin and may not yet have relaxed back into the skin. The final or trailing fin 22 acts in a similar way to the middle fin.

In addition, because of the decreasing radii on the edge of the leading fin to the trailing fin, the scraping effect is increased from the leading to the trailing fin. Thus the leading fin can be the primary fin for gathering the composition and hairs which have already been removed, and the trailing fins may be primarily for detaching weakened hairs.

As the load is spread over three fins the pressure on the skin of the user is also reduced.

Alternatively, or additionally, it may be that a user will not always, for all parts of the skin, be able to maintain all edges in contact with the skin. If the handle is not maintained at its optimum angle to the skin or in its optimal range of angles relative to the skin one or more fins will still effect the required removal of the chemical and detached hairs as well as effecting a scraping action.

The further embodiments will now be described, with emphasis on the main differences from the first embodiment.

Figure 4:
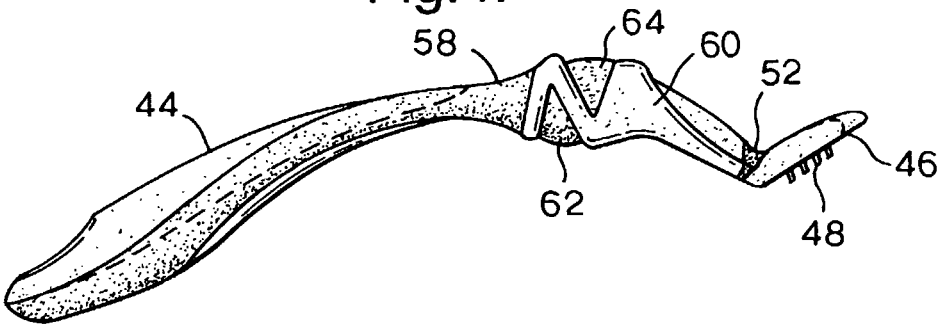
FIG. 4 is a side view of the second embodiment.

The second embodiment shown in FIGS. 3 and 4 has its head 46 tilted upwards relative to the handle 44. The head is a generally oval-shaped, flat body. It has a planar under-surface which carries four straight, parallel fins 48. These can be seen in side view in FIG. 4, and also in FIG. 3, through the head 46, which is of translucent material. The head is connected to the handle by a wedge 52 of elastomeric material which represents a first flex point of the device. On the handle there is a formation 58 designed for a finger or thumb to rest comfortably against it. Just beyond the formation 58, towards the head, a plastics region is formed in the shape of a letter N. From the right-hand limb of this a part 60 extends up to the elastomeric wedge 52. Within the spaces defined by the letter N formation there are packings 62, 64, of elastomeric material. The device thereby has two points of flexure, one being the N-shaped region, and the other being the elastomeric wedge 52.

Figure 5:
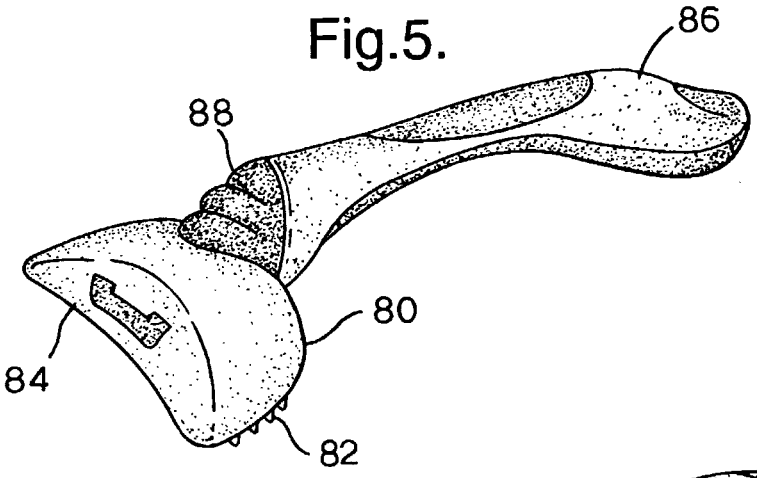
FIGS. 5 and 6 are perspective views from above of third and fourth embodiments.

In the third embodiment shown in FIG. 5 the head 80 is a generally flat part having a flat under-surface, from which four fins 82 project. Even the trailing fin is set back from the distal end 84 of the head. The head does not follow the curvature of the handle 86, but is tilted somewhat upwardly therefrom. A single wedge-shaped elastomeric packing 88 is located in a correspondingly shaped space between the handle and the head, so that the head may flex relative to the handle.

Figure 6:
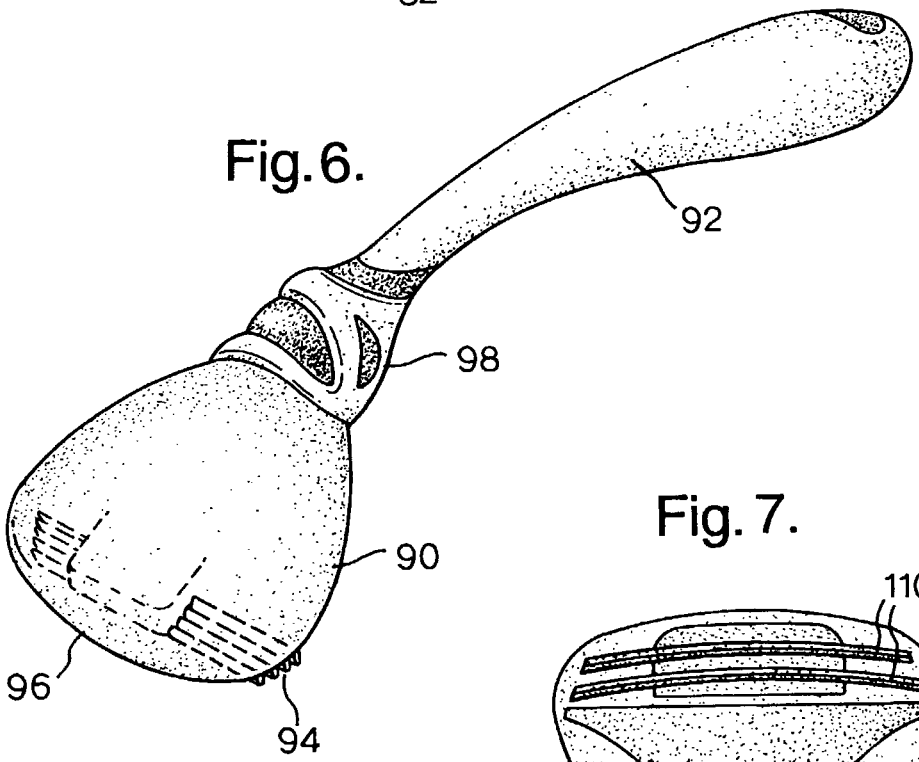

In the fourth embodiment shown in FIG. 6 the head 90 is not tilted relative to the handle 92. Rather, it follows the line of the handle, such that the head and handle together form the shape of an arch, if viewed from one side. Four fins 94 are carried by the generally-flat under-surface of the head 90. Even the trailing fin is spaced back from the distal end 96 of the head. For aesthetic reasons the distal end 96 is curved in this embodiment. The fins are four straight, parallel fins 94 and it should be noted that they differ in height from each other. The trailing fin is shortest. The next fin (that is, away from the distal end 96) is a little longer. The next fin is a little longer again. The leading fin is the longest fin. A single flex point 98 is provided, this being of the N-type of the second embodiment.

Figure 7:
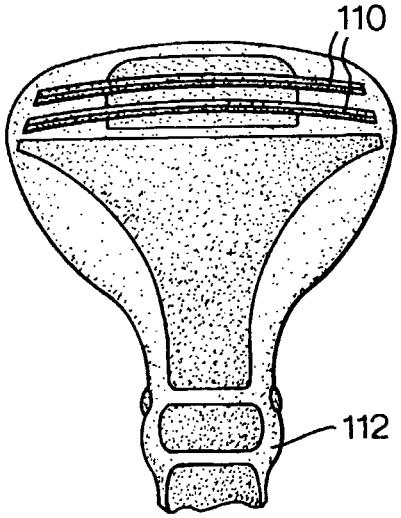
FIG. 7 is a partial plan view from underneath showing the head of a fifth embodiment.

The fifth embodiment shown in FIG. 7 corresponds to the fourth embodiment, except that it has only two fins 110 and in that the fins, though still parallel with each other, are slightly curved, in a parabola, with their concave sides facing towards the handle 112. The curvature of the fins aid the process of removal of depilatory composition and depilated hair. The tendency of the depilatory composition and depilated hair to ooze past the ends of the fins and back onto the skin, rather than be captured by the device, from which it can be washed off, may be reduced.

Figure 8:
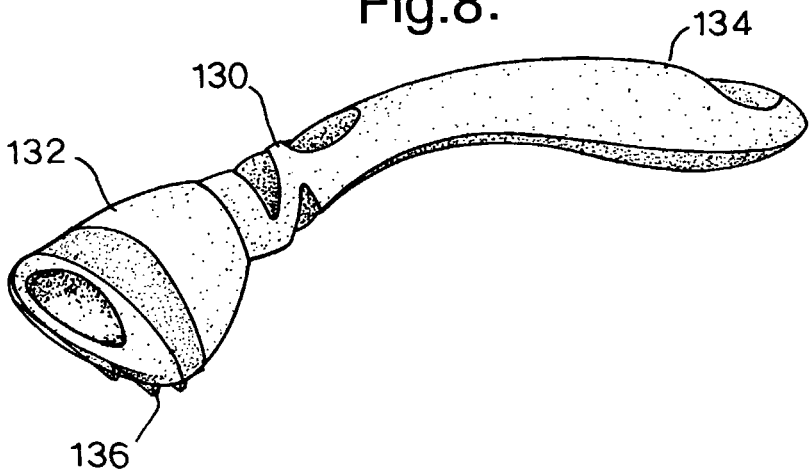
FIG. 8 is a perspective view from above of a sixth embodiment.
Figure 9:
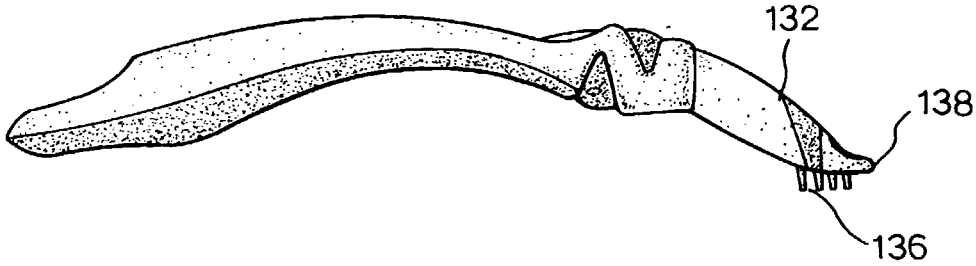
FIG. 9 is a side view of the sixth embodiment.
Figure 10:
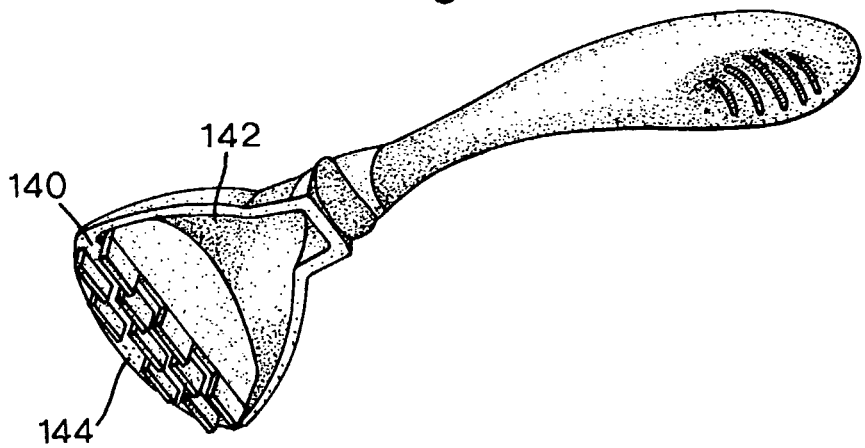
FIG. 10 is a perspective view from below of the sixth embodiment.

The sixth embodiment shown in FIGS. 8 to 10 is similar in overall shape and design to the fourth embodiment; in particular in the design of the single flex point 130, the fact that the head 132 generally follows the shape of the handle 134, and in carrying fins 136 from the under-surface of the head, spaced from the distal end 138 of the head. However the under-surface of the head is formed with a flat frontal region 140, and a rear recessed region 142. In use, depilatory composition and depilated hair may collect in the region 142 so permitting the device to be used for longer sweeps between washing off.

The fins 136 in this sixth embodiment are significantly different from the fins in the first to fifth embodiments. There are ten small fins, and they are arranged in four rows (see FIGS. 13, 14). Each fin is of rectangular shape, 1 cm wide and 5 mm in height. The fins in the same row are separated laterally from each other by 8 mm. The spacing of the rows is 2.5 mm.

In the row nearest to the handle (the row which first contacts the depilatory composition, in use) there are three fins, spaced apart as described above. In the second row there are two fins, and these are aligned with the spaces between the fins of the first row. In the third row there are three fins, and these are aligned with the fins of the first row. In the fourth row, nearest to the distal end 144, there are two fins, and these correspond in position to the fins of the second row.

Figure 11:
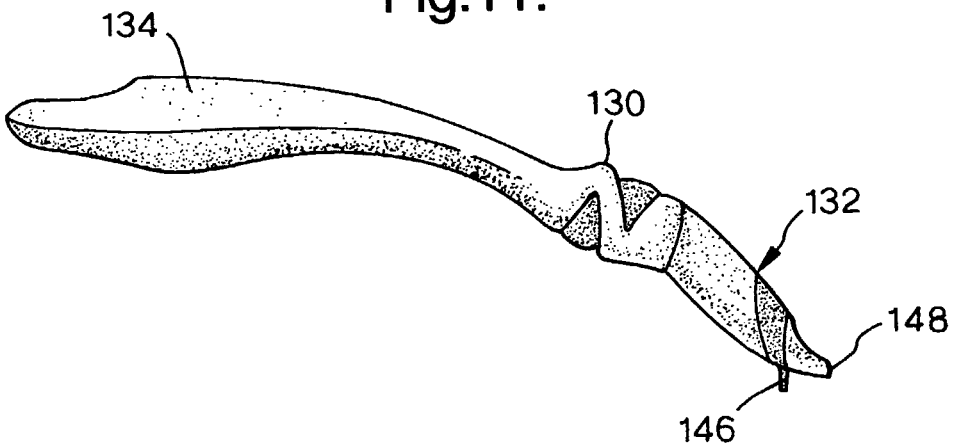
FIG. 11 is side view of a seventh embodiment.
Figure 12:
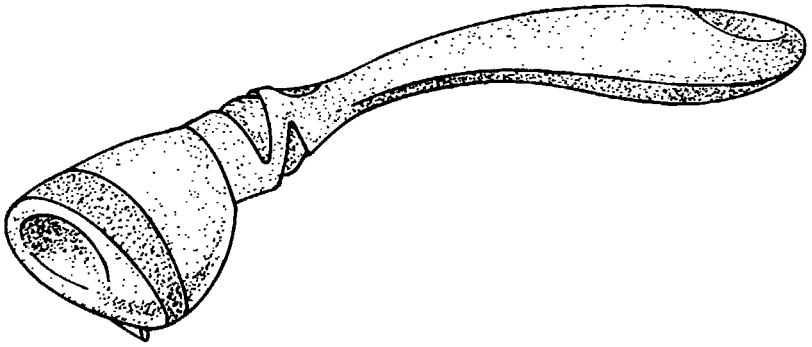
FIG. 12 is a perspective view from above of the seventh embodiment.

FIGS. 11 and 12 show a seventh embodiment with a head of the same general shape as that of the sixth embodiment, but having a single fin 146 only. The fin is straight, and extends from one side of the head to the other. It is set back from the distal end 148.

Figure 13:
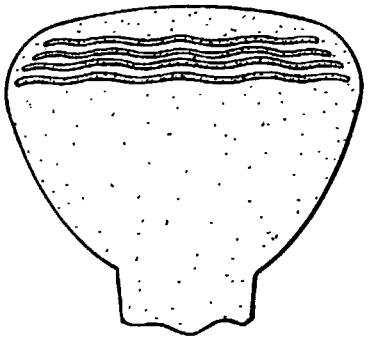
FIGS. 13 and 14 are partial plan views from underneath showing alternative heads to those shown in the fourth embodiment shown in FIG. 6, representing eighth and ninth embodiments.
Figure 14:
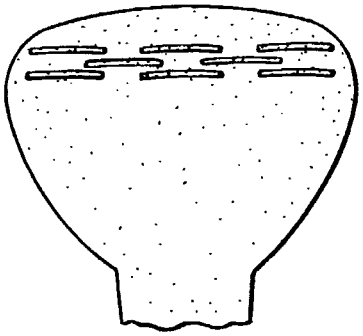

FIGS. 13 and 14 show heads of similar external shape to those shown in FIGS. 6 to 10, but having different designs of fins, carried on the under-surface of the respective head. Their individual characteristics can be seen from the figures, but they are noted in brief as follows:

FIG. 13: this has four parallel fins each of a rippled or wavy shape.

FIG. 14: this has multiple fins, arranged in three rows. Each row has fins separated by spaces. The trailing and leading rows have three fins and two spaces. The middle row has two fins and one space, and these fins are staggered from those of the trailing and leading rows, so that all of each space in the array is aligned with a fin of at least one neighboring row. Each of the fins is curved, with its concave side facing towards the handle.

Figure 15:
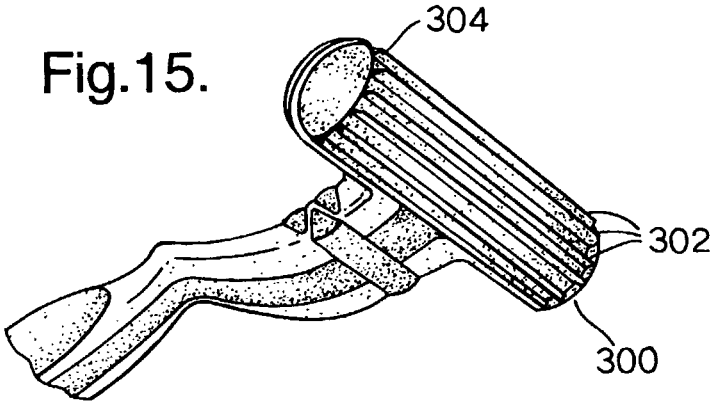
FIG. 15 is a perspective partial view from underneath showing the head of a tenth embodiment.

In the tenth embodiment shown in FIG. 15 the head includes six elastomeric fins 302, each about 35 mm in width. The fins are not parallel to each other. The free edges are parallel but non-coplanar. The plane of each fin projects radially from an curved base 304 of the head, with that section also being of elastomeric material, supported from underneath by plastics material. It will be seen that the fins issue from the base, in a closely spaced and slightly splayed array.

In use, it is unlikely that all of the fins will often contact the skin at any one time but this is possible when the body part contacted is concave, or soft, or when a sufficient force is applied by the user. More commonly one or two fins, typically leading fins, will be spaced from the body to clear the composition to a certain extent. A downstream fin, or fins, will be in contact with the skin, and this will effect a scraping action, which breaks off hairs that have become weakened but not yet detached.

Furthermore, in use it is likely that the user will not always have the handle at the same angle to the skin. However, a satisfactory removal can still be achieved. The head will rock as the angle of the handle changes. Thus the leading fin may have a removal effect, as may the second and third fins, for instance, when the distal end of the handle is closer to the skin. On the other hand, when the distal end of the handle is raised, the trailing fins may effect removal. The leading fins may remove composition but without effecting scraping. It can be seen that more or fewer fins may effect scraping or composition removal only depending upon the angle of the handle and, alternatively or additionally, the pressure applied to the head by the user.

Figure 16:
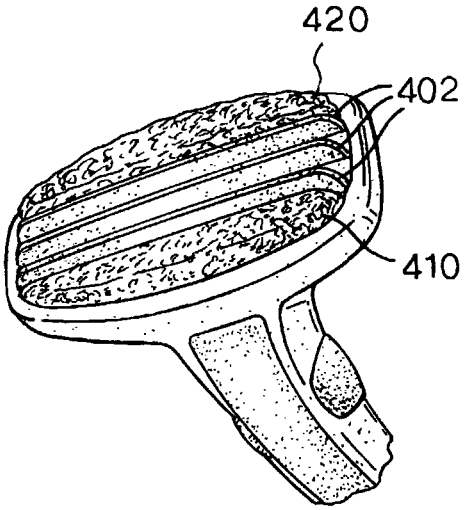
FIG. 16 is a perspective view from above of an eleventh embodiment.
Figure 17:
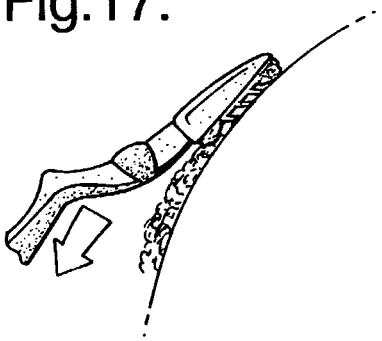
FIG. 17 is a perspective partial view showing the underside of the head of the eleventh embodiment.
Figure 18:
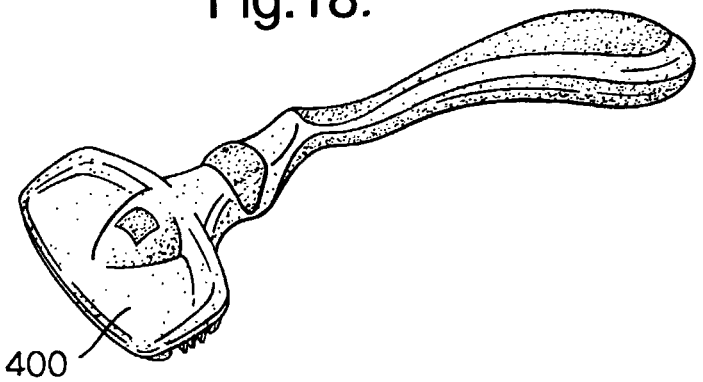
FIG. 18 is a side partial view showing the removal of depilatory composition and depilated hair the skin using the eleventh embodiment.

In the eleventh embodiment shown in FIGS. 16 to 18 the head 400 has a flat under-surface which has three elastomeric fins 402. Each fin is straight, extends across substantially the full width of the head, and is approximately 35 mm in length. The fins are parallel, and closely spaced. The fins may be integrally moulded with the handle (which comprises plastics and elastomeric sections) or may be added separately).

The underside of the head 402 is also provided with a leading section 310 and a trailing section 420. These sections project slightly from the underside of the head but not to the extent that the fins project, when in the relaxed position shown in FIG. 34. However, it can be seen from FIG. 35 that, when the fins flex, these sections 410, 420 may come into contact with the skin.

Either or both of the sections 410 and 420 may be comprised by a slightly compressible material such as sponge and impregnated with or otherwise able to deposit a non-depilatory composition onto the skin, in the same movement in which depilatory composition and depilated hair are removed.

There may be more than the number of sections that are shown either in advance of the fins with respect to the direction of the movement or trailing the blades or both. Alternatively or additionally, such sections may be provided between the fins.

The non-depilatory compositions may, for example, be selected from any one or more of the following substances: oils, moisturisers, perfumes, colourants, soaps, exfoliants and insect repellents. In this embodiment, however, the leading section 410 is of sponge impregnated with a mild liquid soap to lubricate the movement of the fins and the trailing section 420 is of non-woven material impregnated with a dual action moisturiser/fragrance.

The invention claimed is:

1. A non-shaving device for removing a composition from the skin, the device comprising:

a handle;

a non-shaving head not having a cutting device, the non-shaving head comprising an under-surface comprising a substantially flat frontal region and a rear recessed region, wherein at least one fin projects transversely from the under-surface, a first fin comprising a radiused fin tip with a first radius and a second fin comprising a radiused fin tip with a second radius, and wherein the first radius is different than the second radius; and at least two flex points, a first flex point comprising an elastomeric material, the first flex point in communication with the handle and the non-shaving head, the first flex point being integral with the rear recessed region, the first flex point permitting the non-shaving head to flex about the handle, and a second flex point in the handle comprising an "N"-shaped formation defining two spaces, the two spaces comprising an elastomeric material;

wherein the non-shaving head, in use, being arranged to move over the skin such that the at least one fin effects removal of the composition; and wherein the first fin comprises a different material than the second fin.

2. The non-shaving device of claim 1, wherein the under-surface is substantially planar.

3. The non-shaving device of claim 1, wherein at least one fin projects substantially perpendicular to the under-surface of the non-shaving head.

4. The non-shaving device of claim 1, wherein at least one fin is spaced from the distal end of the non-shaving head.

5. The non-shaving device of claim 1, wherein at least one fin comprises an elastomeric material.

6. The non-shaving device of claim 1, wherein the first flex point comprises an elastomeric wedge.

7. The non-shaving device of claim 1, the non-shaving head further comprising a source of a non-depilatory composition.

8. The non-shaving device of claim 7, wherein the non-depilatory composition is selected from the group consisting of a moisturizer, a fragrance, an oil, a colorant, a soap, an exfoliating agent, a sunscreen, an after-sun agent, a deodorant, a lubricant, an insect repellent, and combinations thereof.

9. The non-shaving device of claim 1, wherein the first radius comprises a compound radius.

10. The non-shaving device of claim 1, wherein an average width of the non-shaving head is at least 80% greater than an average width of the handle.

11. The non-shaving device of claim 1, wherein a length of the handle is over 500% greater than a length of the non-shaving head.

12. The non-shaving device of claim 1, wherein each fin has a width of greater than 30 mm.

13. A non-shaving device for removing a depilatory composition and hair from the skin, comprising:

an arched handle and associated therewith at one end of the arched handle, a non-shaving head lacking a cutting device, the non-shaving head comprising:

an under-surface formed with a curved base and a rear recessed region; and at least three elastomeric fins for removing the depilatory composition projecting transversely from the under-surface, each fin projecting radially outward from the curved base such that distal edges of each fin are parallel to but not coplanar with each other;

a first flex point being integral with the rear recessed region; and a second flex point in the handle comprising an "N"-shaped formation defining two spaces, the two spaces comprising an elastomeric material;

wherein the non-shaving head, in use, being arranged to move over the skin such that the elastomeric fins effect removal of the depilatory composition and entrained hair from the skin, and the arched handle allows a user thereof to keep the user's hand clear of the depilatory composition and entrained hair; and wherein the first fin comprises a plastic material and the second fin comprises an elastomeric material.

14. The non-shaving device of claim 13 further comprising at least one fin projecting substantially perpendicular to the under-surface of the non-shaving head.

15. The non-shaving device of claim 13, wherein at least one fin is spaced from the distal end of the non-shaving head.

16. The non-shaving device of claim 13, wherein the first flex point comprises an elastomeric wedge.

17. The non-shaving device of claim 13, the non-shaving head further comprising a source of a non-depilatory composition.

18. The non-shaving device of claim 17, wherein the non-depilatory composition is selected from the group consisting of a moisturizer, a fragrance, an oil, a colorant, a soap, an exfoliating agent, a sunscreen, an after-sun agent, a deodorant, a lubricant, an insect repellent, and combinations thereof.

19. The non-shaving device of claim 13, wherein an average width of the non-shaving head is at least 80% greater than an average width of the arched handle.

20. The non-shaving device of claim 13, wherein a length of the arched handle is over 500% greater than a length of the non-shaving head; and wherein each fin has a width of greater than 30 mm.

* * * * *